United States Patent [19]

Tarter et al.

[11] 3,976,394

[45] Aug. 24, 1976

[54] INTERSTAGE BLEED ASSEMBLY

[75] Inventors: David A. Tarter, Cincinnati, Ohio; Jack L. Readnour, Fort Mitchell, Ky.

[73] Assignee: The United States of America as represented by the Secretary of the Air Force, Washington, D.C.

[22] Filed: July 18, 1975

[21] Appl. No.: 597,061

[52] U.S. Cl. ..... 415/144; 415/217

[51] Int. Cl.[2] ..... F04D 27/02

[58] Field of Search ..... 415/144, 136, 172 A, 415/171, 170, 145, 217

[56] References Cited

UNITED STATES PATENTS

| | | | |
|---|---|---|---|
| 3,142,438 | 7/1964 | McKenzie | 415/144 |
| 3,227,418 | 1/1966 | West | 415/136 |
| 3,501,246 | 3/1970 | Hickey | 415/170 R |
| 3,632,223 | 1/1972 | Hampton | 415/144 |
| 3,777,489 | 12/1973 | Johnson et al. | 415/144 |

*Primary Examiner*—Henry F. Raduazo

*Attorney, Agent, or Firm*—Joseph E. Rusz; Richard J. Killoren

[57] ABSTRACT

A two part metering adapter ring, for providing bleed air from the compressor of an aircraft engine, having a plurality of metering air flow passages. The adapter ring is secured to the outer casing stator support member and has a movable seal engaging a member on the inner casing stator support member. A pair of spring members hold the seal in contact with the seal engaging member on the inner casing stator support member.

2 Claims, 7 Drawing Figures

INTERSTAGE BLEED ASSEMBLY

RIGHTS OF THE GOVERNMENT

The invention described herein may be manufactured and used by or for the Government of the United States for all governmental purposes without the payment of any royalty.

BACKGROUND OF THE INVENTION

In some aircraft engines, bleed air is taken off at the 5th compressor stage and supplied to a plenum for air frame use. The bleed air is taken through a metering gap between the outer compressor stator casing and the inner compressor stator casing. The metering passage is intended to pass about 5% of the total compressor air flow to the air frame plenum. It has been difficult to control the area of the bleed passage due to mechanical stackup and thermal growth of the outer and inner casings. Also, the continuous gap allows wakes and swirls in the orifice flow path which lowers the stall margin.

BRIEF SUMMARY OF THE INVENTION

According to this invention, a sealing member is secured to the outer compressor casing. A seal is provided between the sealing member and the inner compressor casing. The sealing member has a plurality of metering holes drilled therein which provides for a constant bleed air flow area. Also, by providing bleed holes instead of a continuous gap the wakes and swirls normally present in the bleed air flow path are considerably reduced.

IN THE DRAWINGS

DETAILED DESCRIPTION OF THE INVENTION

Figure 1:
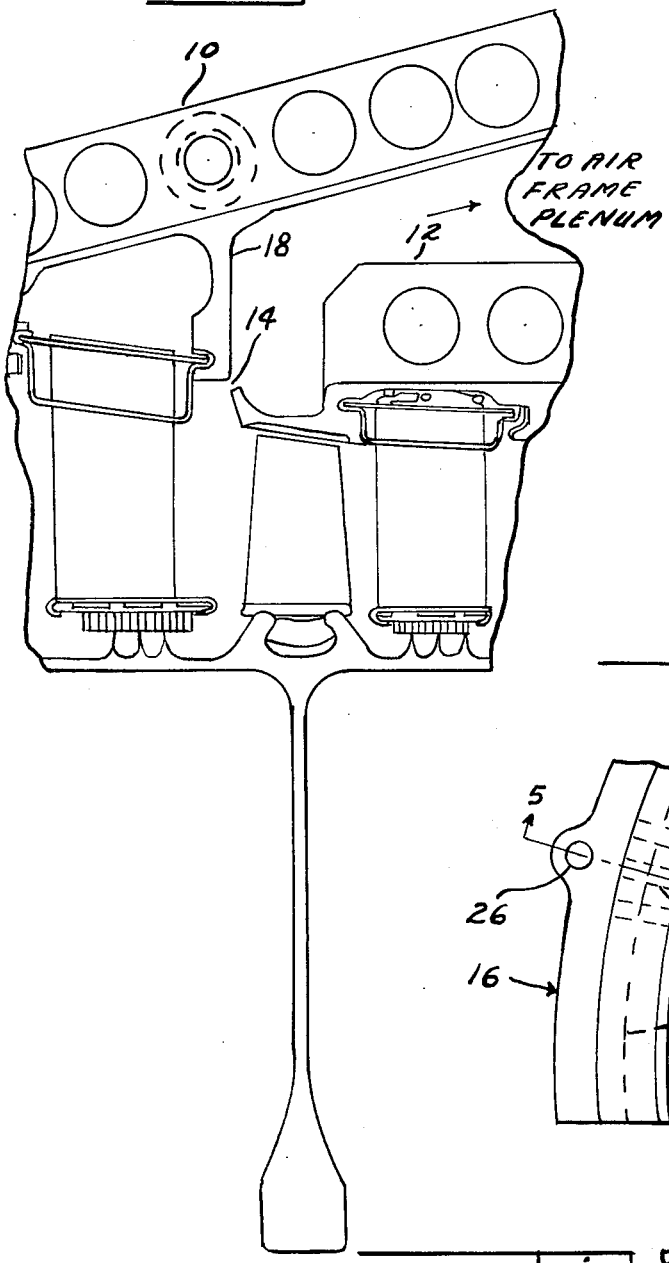
FIG. 1 is a schematic cut away view of a conventional aircraft engine compressor bleed air system for supplying the air frame plenum.

Reference is now made to FIG. 1 of the drawing which shows a cut away section of an aircraft engine compressor having an outer stator support casing member 10 and an inner casing stator support member 12. An air flow passage, such as shown at 14, is sometimes provided at the 5th compressor stage to provide air for air frame use.

Figure 2:
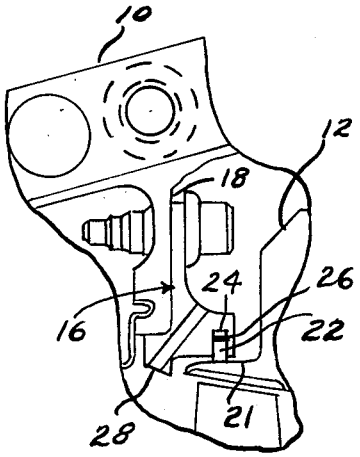
FIG. 2 is a schematic cut away view showing the bleed air system according to the invention.
Figure 4:
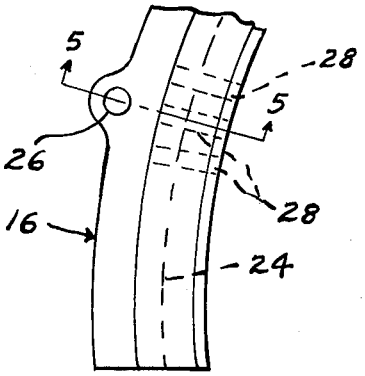
FIG. 4 is an enlarged cut away view of the metering adapter ring of FIG. 3.
Figure 5:
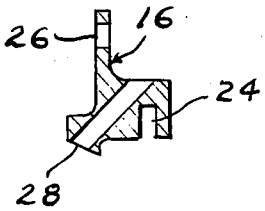
FIG. 5 is a sectional view of the device of FIG. 4 along the line 5—5.
Figure 3:
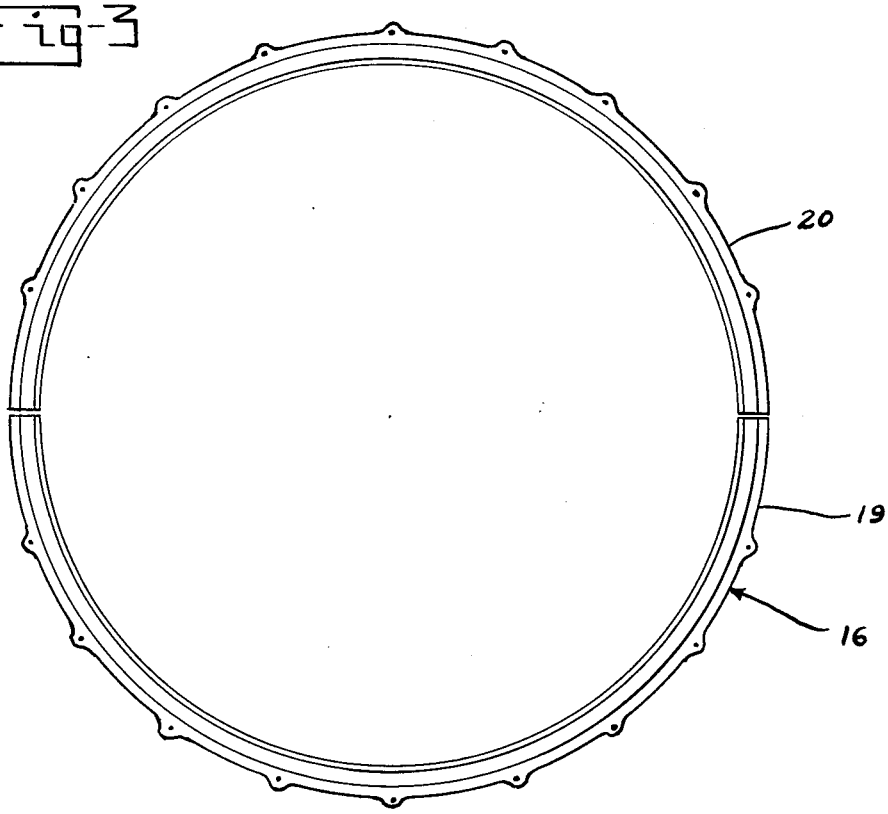
FIG. 3 is a schematic plan view of the metering adapter ring of FIG. 2.
Figure 6:
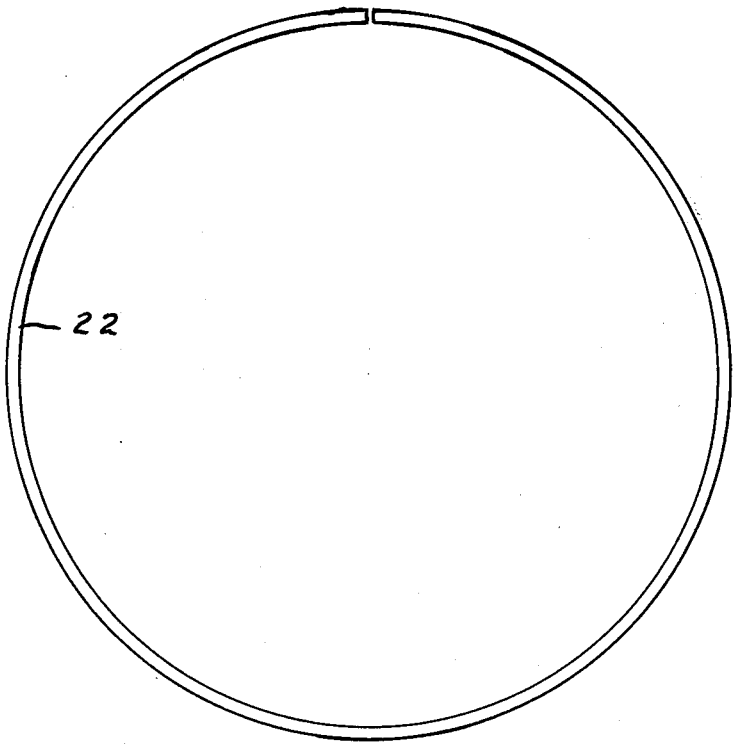
FIG. 6 is a schematic plan view of split ring seal of FIG. 2.
Figure 7:
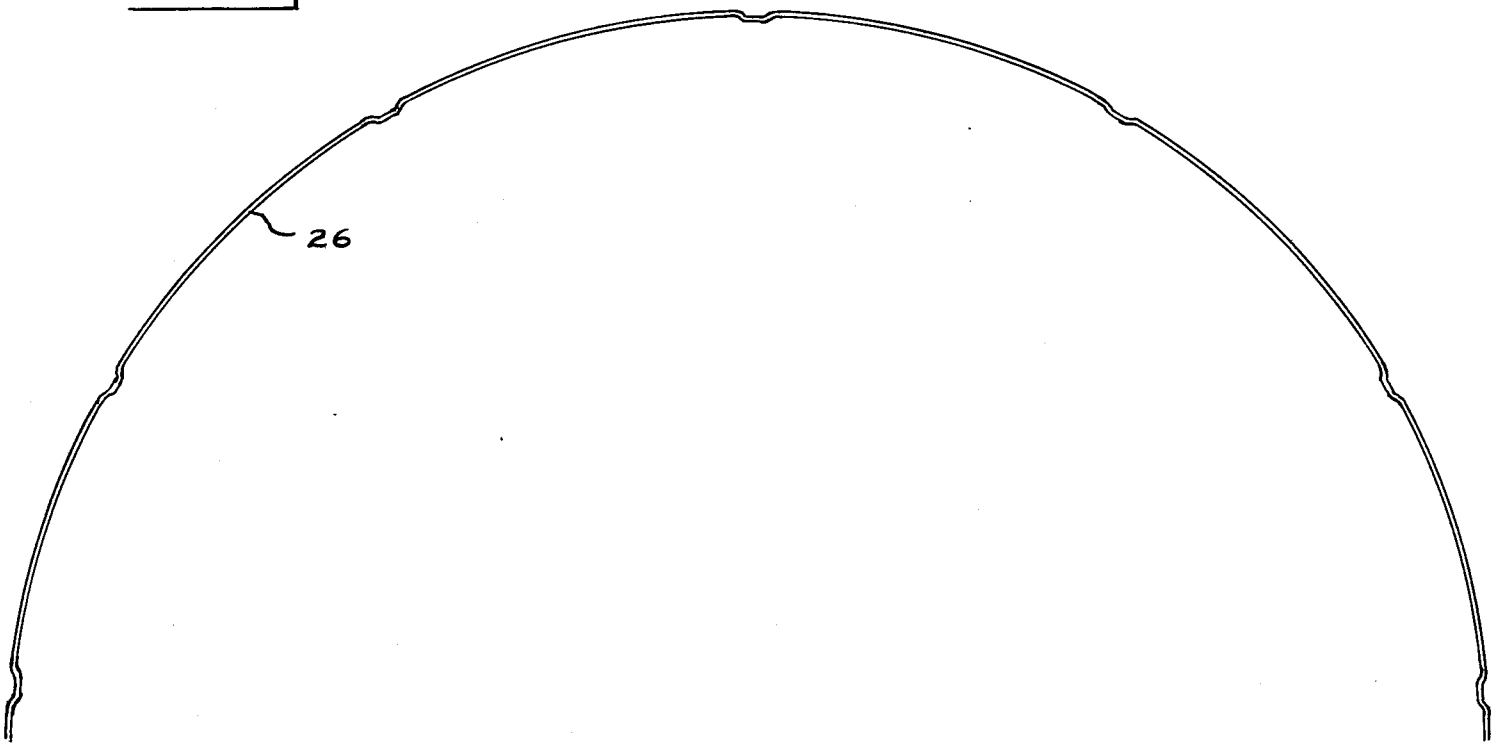
FIG. 7 is an enlarged schematic plan view of one of the spring members of the device of FIG. 2.

According to this invention, as shown in FIG. 2, a metering adapter ring 16, shown in greater detail in FIGS. 3-5 is secured to blade support member 18. The member 16 is made in two parts 19 and 20, as shown in FIG. 3, to aid in the assembly. The member 21, on the inner casing stator support member 12 provides a sealing surface for a split ring seal 22, shown in greater detail in FIG. 6. The seal 22 is positioned in slot 24 in the metering adapter ring 16. The seal 22 is held in contact with member 21 by means of two spring members, one of which is shown at 26 in FIG. 7. The spring members 26 are positioned in each of the parts 19 and 20 of the metering adapter ring 16 prior to assembly. The metering adapter member ring 16 has a plurality of air flow metering holes 28 spaced around the member. While only three holes 28 are indicated in FIG. 4, like holes are spaced completely around the adapter ring member 16.

In the operation of the apparatus of the invention, the holes 28 in the metering adapter ring 16 control the amount of air flowing from the 5th compressor to the plenum for air frame use. Any leakage flow, such as around the ring seal 22, will be negligible compared to the total flow through the holes 28. Positioning of the ring seal 22 on the member 21 will provide for variations in the spacing between support member 18 and the member 21 on the inner stator casing member 12, due to variations in mechanical stackup and variations due to thermal growth.

There is thus provided an apparatus for supplying compressor bleed air for the air frame plenum having a uniform bleed air passage and which substantially eliminates wakes and swirls in the flow passage.

We claim:

1. In an apparatus for providing bleed air to a plenum for air frame use from the compressor of an aircraft engine wherein the air is normally taken through a metering gap between the outer compressor stator casing and the inner compressor stator casing: an apparatus for controlling the flow of air from the compressor to the plenum, comprising: a two part sealing member secured to the outer compressor stator casing; said sealing member having a portion extending across said gap between the outer compressor stator casing and the inner compressor stator casing; means for providing a seal between said sealing member and said inner compressor stator casing; said sealing member having means for controlling the flow of air from said compressor to the air frame plenum.

2. The device as recited in claim 1 wherein said means for controlling the flow of air from said compressor to the air from plenum consist of a plurality of metering apertures in each of the two parts of said sealing member.

* * * * *